US009819111B2

(12) United States Patent
Holub et al.

(10) Patent No.: US 9,819,111 B2
(45) Date of Patent: Nov. 14, 2017

(54) CONNECTOR WITH TERMINAL CARRIER LOCK AND INDIVIDUAL TPA RETENTION FEATURES

(71) Applicant: J.S.T. CORPORATION, Farmington Hills, MI (US)

(72) Inventors: Franklin A. Holub, West Bloomfield, MI (US); Ryan Dombrowski, Ann Arbor, MI (US)

(73) Assignee: J.S.T. CORPORATION, Farmington Hills, MI (US)

( * ) Notice: Subject to any disclaimer, the term of this patent is extended or adjusted under 35 U.S.C. 154(b) by 0 days.

(21) Appl. No.: 15/428,217

(22) Filed: Feb. 9, 2017

(65) Prior Publication Data

US 2017/0237193 A1 Aug. 17, 2017

Related U.S. Application Data

(60) Provisional application No. 62/294,566, filed on Feb. 12, 2016.

(51) Int. Cl.

| | |
|---|---|
| ***H01R 13/514*** | (2006.01) |
| ***H01R 13/426*** | (2006.01) |
| ***H01R 43/20*** | (2006.01) |
| ***H01R 13/436*** | (2006.01) |

(52) U.S. Cl.

CPC ..... *H01R 13/426* (2013.01); *H01R 13/4362* (2013.01); *H01R 43/20* (2013.01)

(58) Field of Classification Search

CPC .. H01R 13/434; H01R 13/502; H01R 13/514; H01R 13/4362; H01R 13/641; H01R 13/6275

USPC ..... 439/352, 489, 686, 701, 745, 752

See application file for complete search history.

(56) References Cited

U.S. PATENT DOCUMENTS

| | | | | |
|---|---|---|---|---|
| 5,004,436 A * | 4/1991 | Aoyama | H01R 13/4368 | 439/595 |
| 6,045,410 A * | 4/2000 | Norizuki | H01R 13/506 | 439/686 |
| 7,063,578 B2 * | 6/2006 | Goto | H01R 13/4361 | 439/595 |
| 7,278,890 B1 * | 10/2007 | Smutny | H01R 13/4361 | 439/752 |
| 7,661,999 B2 * | 2/2010 | Horiuchi | H01R 13/4362 | 439/595 |
| 7,695,315 B2 * | 4/2010 | Hitchcock | H01R 13/4223 | 439/541.5 |

(Continued)

*Primary Examiner* — Chandrika Prasad

(74) *Attorney, Agent, or Firm* — Kratz, Quintos & Hanson, LLP

(57) ABSTRACT

An electrical connector system includes a terminal carrier lock having a housing defining a cavity or a plurality of cavities. For each cavity, there is a forward stop structure on one side of the cavity and a primary terminal lock on the opposite side of the cavity. The forward stop structure has a terminal forward stop and a pre-lock retention ledge. The corresponding female shroud has a shroud housing defining a cavity or a plurality of cavities, and for each cavity there is a shroud retention feature for engaging the pre-lock retention ledge, and a positive lock retention surface and a terminal position assurance shelf on the inside of the housing facing the cavity. The connector system of the invention provides a terminal position assurance retention feature in each cavity.

12 Claims, 9 Drawing Sheets

(56) References Cited

U.S. PATENT DOCUMENTS

2007/0281555 A1* 12/2007 Suemitsu ..... H01R 13/4362
439/752

* cited by examiner

CONNECTOR WITH TERMINAL CARRIER LOCK AND INDIVIDUAL TPA RETENTION FEATURES

CROSS-REFERENCE TO RELATED APPLICATIONS

This application claims the benefit of U.S. provisional application Ser. No. 62/294,566, filed on Feb. 12, 2016.

STATEMENT REGARDING FEDERALLY SPONSORED RESEARCH OR DEVELOPMENT

Not applicable.

THE NAMES OF PARTIES TO A JOINT RESEARCH AGREEMENT

Not applicable.

STATEMENT REGARDING PRIOR DISCLOSURES BY THE INVENTOR OR A JOINT INVENTOR

Not applicable.

BACKGROUND OF THE INVENTION

Field of the invention

The present invention is in the field of electrical connectors.

Description of the related art

In the field of electrical connectors, such as those used in automotive applications, connectors typically have a terminal position assurance (TPA) mechanism, which assures that the terminals are in proper position longitudinally within the respective cavities of the connector. A typical example is seen in U.S. Pat. No. 6,045,410, to Myer. The electrical connectors have housings having cavities extending therethrough for receiving terminals. Typically, a connector has a terminal carrier lock and a female shroud portion, which are mated to a pre-lock position. The terminals are then inserted into the terminal carrier lock portion. If the terminals are not properly seated, the TPA mechanism prevents the terminal carrier lock and female shroud portion from being mated to the fully locked position.

BRIEF SUMMARY OF THE INVENTION

The present invention provides a connector system in which the terminal carrier lock component has a housing defining a cavity, a forward stop structure connected to the housing on one side of the cavity and extending away from the housing on one side of the housing, and a primary terminal lock connected to the housing on the opposite side of the cavity and extending away from the housing on the same side as the forward stop structure, wherein the forward stop structure includes a pre-lock retention ledge on a side of the forward stop structure facing away from the primary terminal lock, the pre-lock retention ledge facing toward the housing; and a terminal forward stop on a side of the forward stop structure facing the primary terminal lock, the terminal forward stop facing toward the housing; and wherein the primary terminal lock includes a beam connected to the housing, the beam being flexible in the directions toward and away from the forward stop structure, a lock surface at the end of the beam, the lock surface facing away from the housing, and a tip extending further away from the housing past the lock surface.

The female shroud portion of the connector includes a shroud housing defining a cavity; a shroud retention feature on one side of the housing; and a positive lock retention surface and a terminal position assurance shelf on the inside of the housing facing the cavity of the female shroud, for contacting the tip of the primary terminal lock.

In a terminal carrier lock having multiple cavities, each cavity can have a forward stop structure and a primary terminal lock, thereby providing individual TPA retention features in each cavity, to assure that the terminal carrier lock and the female shroud cannot be separated beyond the pre-lock position, while not inhibiting the movement between the pre-lock position and fully locked position.

DETAILED DESCRIPTION OF THE INVENTION

Figure 1:
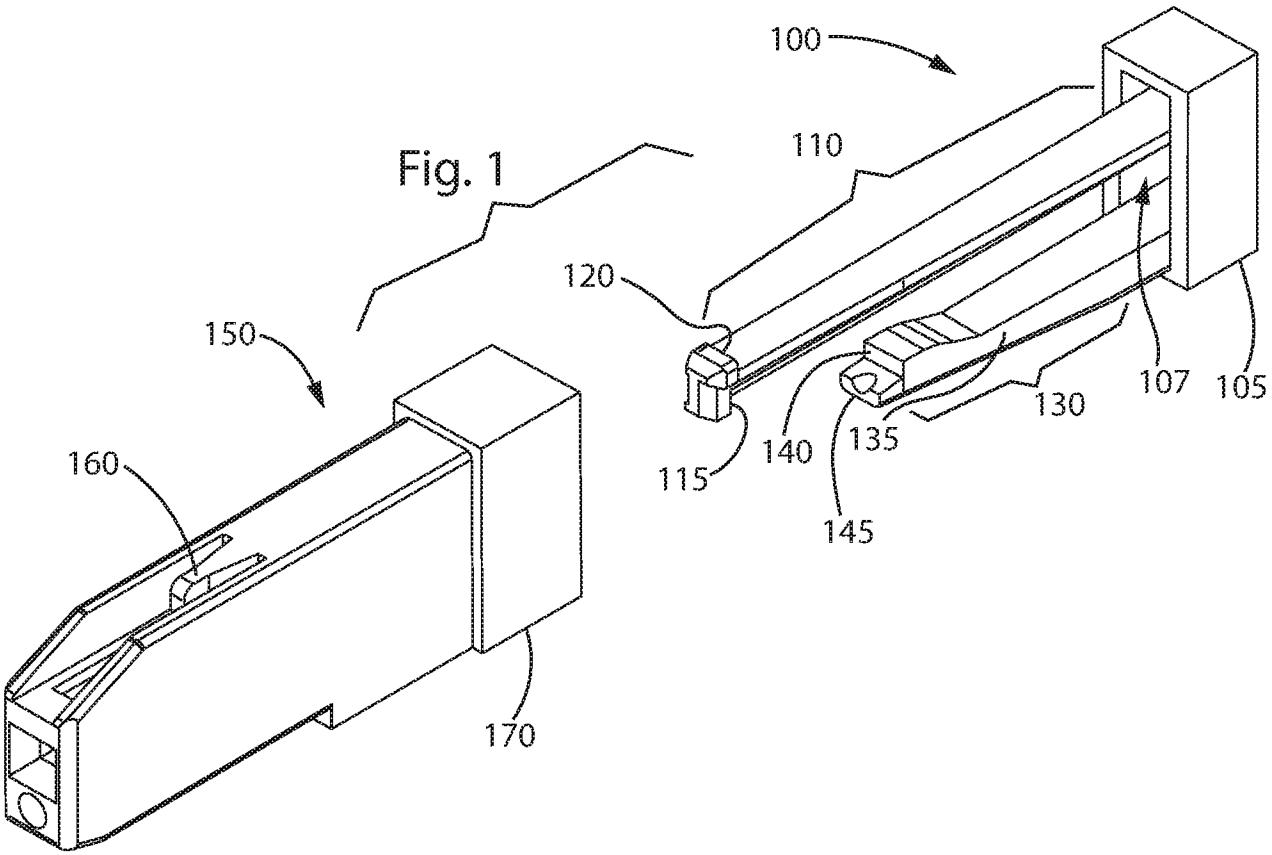
FIG. 1 is a perspective view illustrating the terminal carrier lock component and the female shroud component of a single-cavity embodiment of the invention.

The connector of the invention will typically have a plurality of cavities for insertion of a plurality of electrical terminals. For simplicity of illustration, FIG. 1 illustrates a single cavity embodiment of the invention. In FIG. 1, the connector has two components: a terminal carrier lock 100 and a female shroud 150. The electrical terminal is not shown in FIG. 1.

The terminal carrier lock 100 of the connector has a housing 105 that defines a cavity 7 for insertion of a terminal and electrical cable, and which supports a forward stop structure 110 and a primary terminal lock 130, on opposite sides of the cavity 7. At the end of the forward stop structure 110 away from the housing, there is a pre-lock retention ledge 120 facing the housing on the upper side (the side away from the primary terminal lock 130) of the forward stop structure 110, and there is a terminal forward stop 115 facing away from the housing, on the lower side (the side facing the primary terminal lock 130) of the forward stop structure 110. The primary terminal lock 130 has a beam 135. At the end of beam 135 is a lock surface 140 and a tip 145 extending past lock surface 140. The primary terminal lock 130 serves as a lance or lock finger. Beam 135 has some flexibility toward and away from forward lock structure 110.

The female shroud 150 of the connector has a shroud housing 170 defining a cavity (facing away from the viewer in FIG. 1) that admits the forward stop structure 110 and the primary terminal lock 130 of the terminal carrier lock 100. On the upper side of the female shroud 150, as shown in FIG. 1, is a shroud retention feature 160, which is capable of engaging the pre-lock retention ledge 120 of the forward stop structure 110 of terminal carrier lock 100.

In use, the terminal carrier lock 100 is inserted into the female shroud 150. The connector is designed such that these components are assembled to a pre-lock position, in which the terminal lock carrier 100 and female shroud 150 components are not fully engaged, but are pre-locked so that they cannot be separated by pulling. This aspect of the connector is the TPA Retention feature. Typically, connectors are delivered for use in the pre-lock position. The terminal is then inserted into the cavity of the terminal carrier lock such that it contacts the terminal forward stop 115 of the forward stop structure 110, and the rear of the terminal is held in place by lock surface 140 of primary terminal lock 130.

Figure 2:
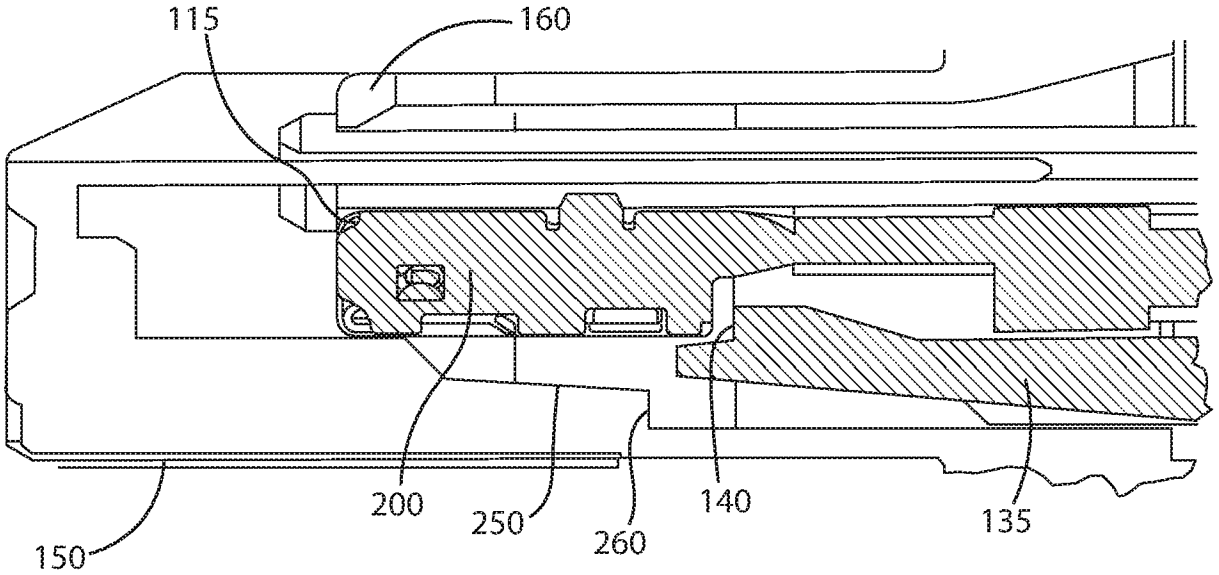
FIG. 2 is a longitudinal vertical cross-sectional view of the single-cavity embodiment of the invention in which the terminal carrier lock is inserted into the female shroud to the pre-lock position.

FIG. 2 illustrates a cross-section of the connector in the pre-lock position after a terminal 200 is inserted. As seen in FIG. 2, when inserted into the pre-locked connector, the terminal 200 is located between the terminal forward stop 115 and the lock surface 140. In the pre-lock position shown in FIG. 2, the shroud retention feature 160 of the female shroud 150 engages the pre-lock retention ledge 120. This engagement in the pre-lock position provides the TPA Retention feature that prevents the terminal carrier lock 100 from being pulled apart from the female shroud 150.

Also seen in FIG. 2 the inside of the female shroud 150 has a positive lock retention (PLR) surface 250 and a shelf 260. If the terminal 200 is not fully inserted to terminal forward stop 115, the terminal 200 will press on the top of primary terminal lock 130 pressing beam 135 downward, and if the terminal carrier lock 100 is pressed into the female shroud 150 in this configuration, tip 145 of the primary terminal lock 130 will contact shelf 260, preventing further movement. Therefore, if the terminal 200 is not properly positioned, the connector cannot be pressed together toward the locked position. This provides the terminal position assurance (TPA) feature of the connector, preventing locking if a terminal is not in position.

Figure 3:
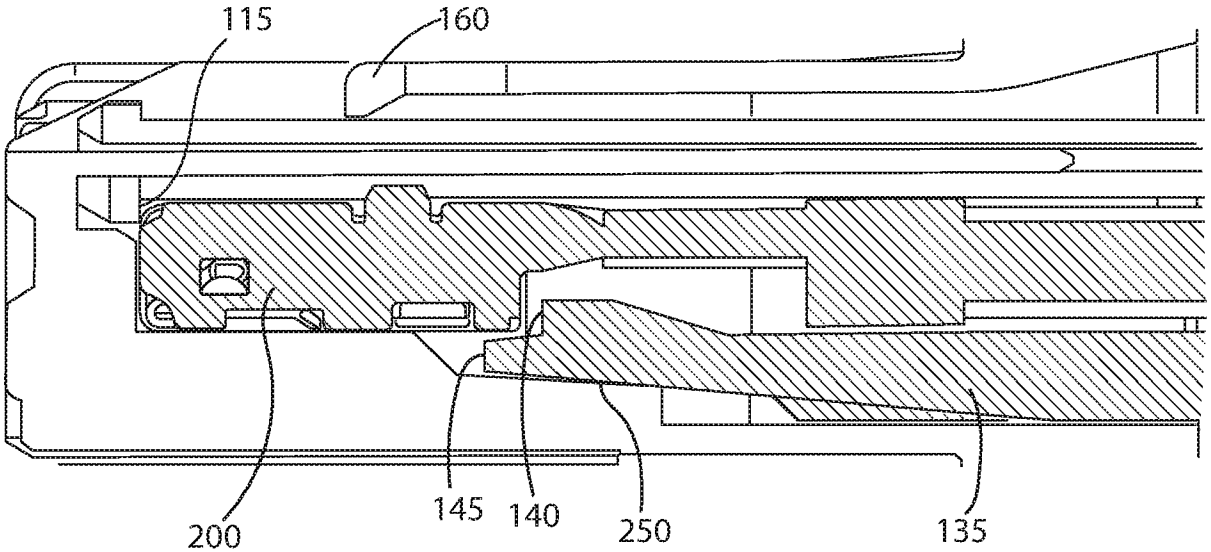
FIG. 3 is a longitudinal vertical cross-sectional view of the single-cavity embodiment of the invention in which the terminal carrier lock is inserted into the female shroud to the locked position.

In use, once the terminal 200 is inserted properly, the terminal carrier lock 100 can be further pushed into the female shroud 150 to the locked position, which is illustrated in FIG. 3. In this position, tip 145 of the primary terminal lock 130 is prevented from downward movement by positive lock retention surface 250. This prevents any downward movement of beam 135 and positions lock surface 140 in such a position that terminal 200 cannot be pulled out from the connector. This provides another aspect of the terminal position assurance (TPA) feature of the connector, preventing unlocking of a terminal if the terminal position assurance (TPA) is in the fully seated position.

The connector of FIGS. 1, 2 and 3 has a single cavity for holding a single terminal. Typically, connectors will have multiple cavities. Another embodiment of the invention is therefore a connector having a plurality of cavities for holding a plurality of terminals.

Figure 4:
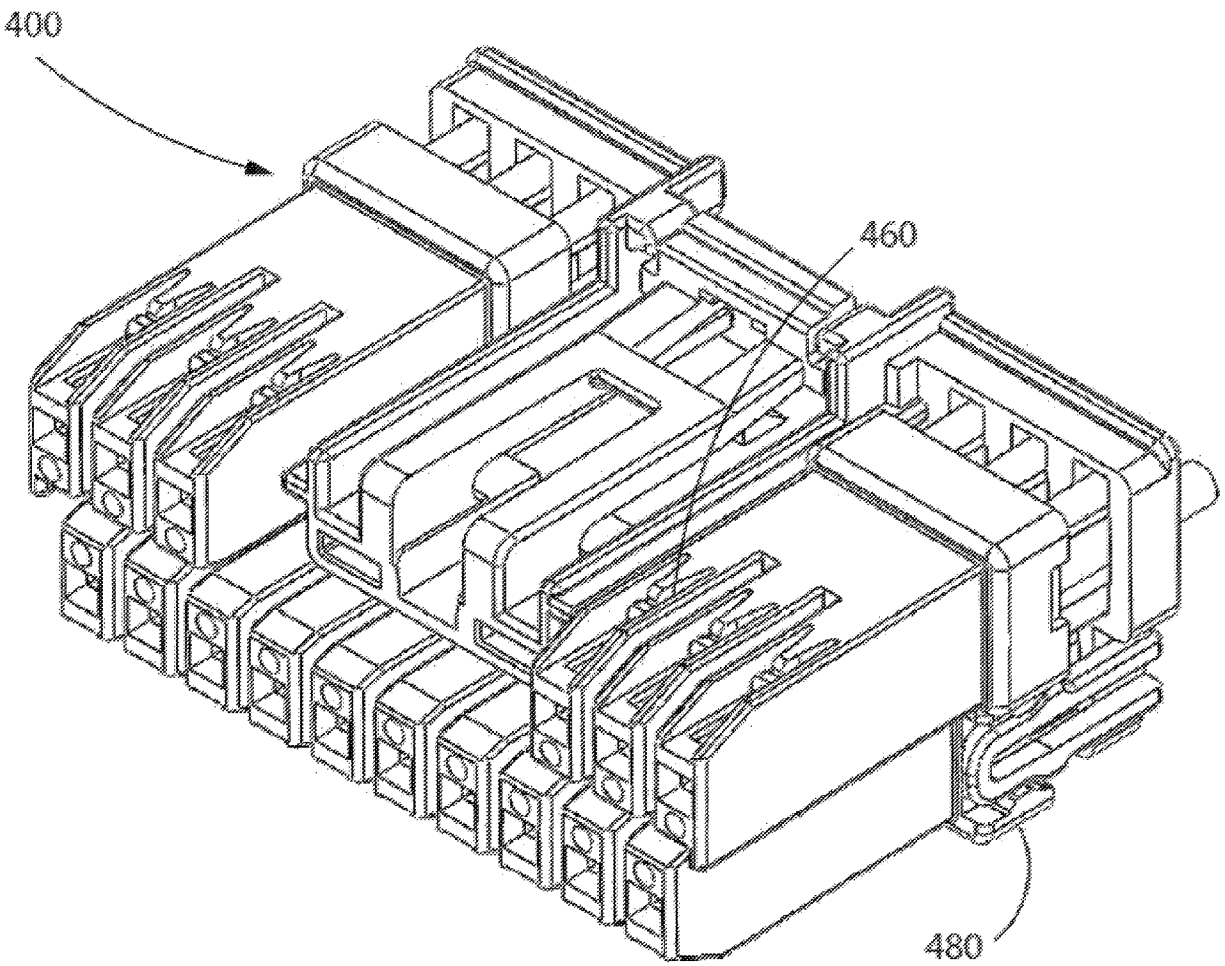
FIG. 4 is a perspective view of a female shroud of an embodiment of the connector of the invention having multiple cavities.
Figure 5:
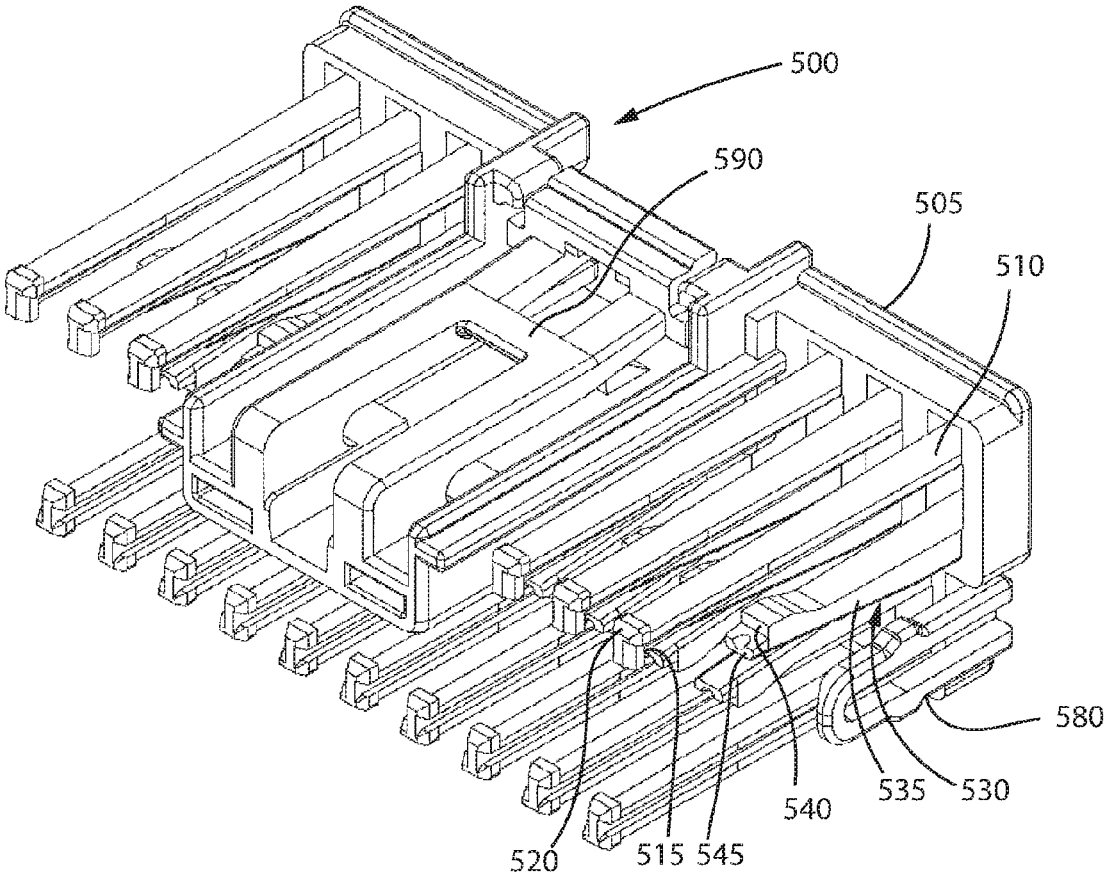
FIG. 5 is a perspective view of the terminal carrier lock of the multiple cavity embodiment of the invention.

An example of a connector of the invention having multiple cavities is shown in FIG. 4, which illustrates the female shroud 400, and FIG. 5, which illustrates the terminal carrier lock 500. As can be seen in FIG. 4, the female shroud 400 is an integral unit having a plurality of cavities of the general structure seen in FIG. 1. In particular, each cavity has a corresponding shroud retention feature 460.

As can be seen in FIG. 5, the terminal carrier lock 500 has a corresponding plurality of structures corresponding to terminal lock 100 in FIG. 1, with the housings connected into an integral housing. Each cavity has a forward stop structure 510 and a primary terminal lock 530. The forward stop structure has pre-lock retention ledge 520 and terminal forward stop 515, corresponding to the elements described above for the single-cavity embodiment in FIG. 1. The primary terminal lock has beam 535, lock surface 540, and tip 545, corresponding to the elements described above for the single-cavity embodiment in FIG. 1.

In the embodiment shown in FIG. 5, the terminal carrier lock 500 also has a main connector latch 580, which engages with a corresponding latch component 480 on the female shroud 400. This latch structure serves to guide the user to the pre-lock position and to latch the terminal carrier lock 500 to the female shroud 400 in the locked position. Such latches are well known in the art and are not further described here. In the embodiment shown, there are two such latches, on opposite sides of the connector assembly.

In the embodiment shown in FIG. 5, the terminal carrier lock 500 also has a connector position assurance (CPA) receiving structure 590. Connector position assurance functions are well known in the prior art, and provide a locking mechanism that prevents a male and female connector pair from accidentally unmating. In use, a connector position assurance unit is inserted into the connector position assurance receiving structure 590, and when fully inserted, locks the unit. The CPA structure shown in FIG. 5 is exemplary and other known structures can he used.

Figure 6A:
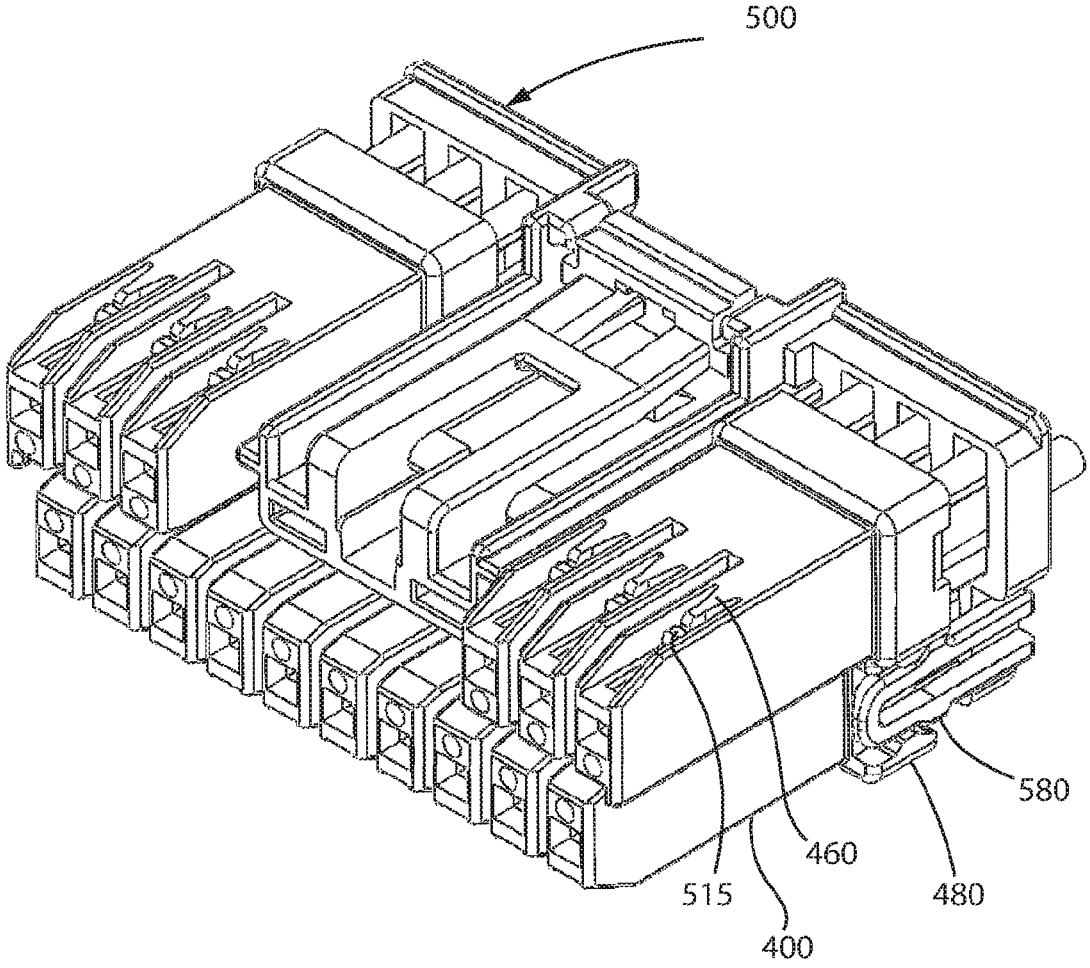
FIG. 6A is a perspective view showing the multiple cavity embodiment of the invention with the female shroud mated to the terminal carrier lock in the pre-lock position.

FIG. 6A illustrates this multiple-cavity embodiment as an assembly with the female shroud 400 and the terminal carrier lock 500 mated in the pre-lock position, with terminals inserted. The terminals are connected to cables 600. In FIG. 6, the engagement between shroud retention feature 460 and pre-lock retention ledge 520 is visible.

Figure 6B:
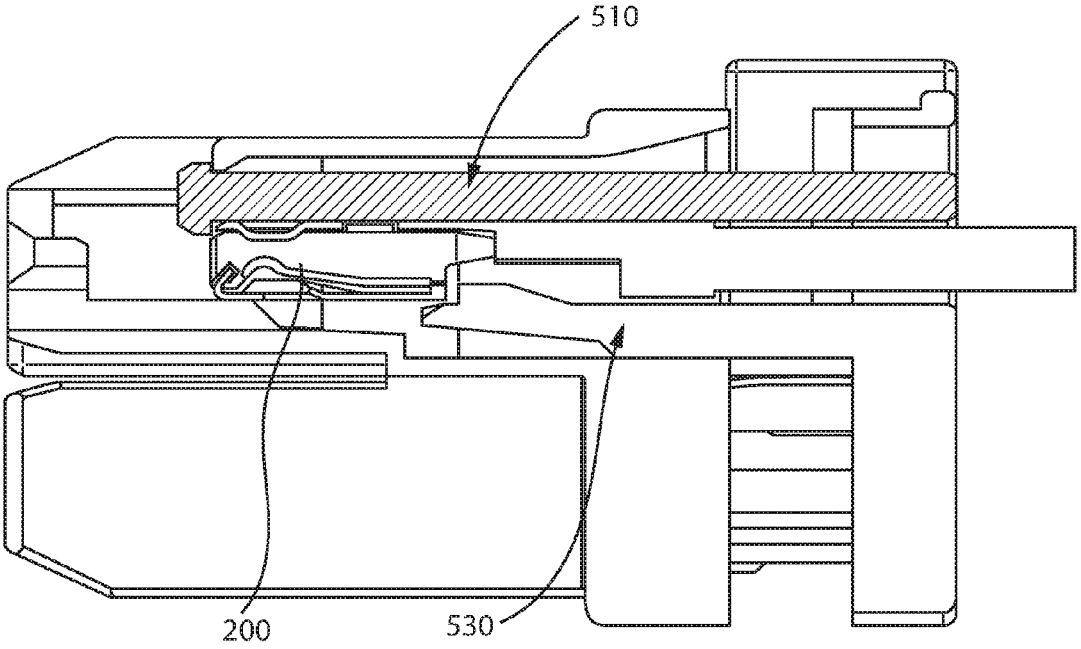
FIG. 6B is a longitudinal vertical cross-sectional view through the pre-locked connector of FIG. 6.

FIG. 6B illustrates a cross-sectional view of the pre-locked assembly of FIG. 6A, such that one forward stop structure 510 and one primary terminal lock 530 are shown. The structure can be understood to generally correspond to that of FIG. 2 for the one-cavity embodiment.

Figure 7A:
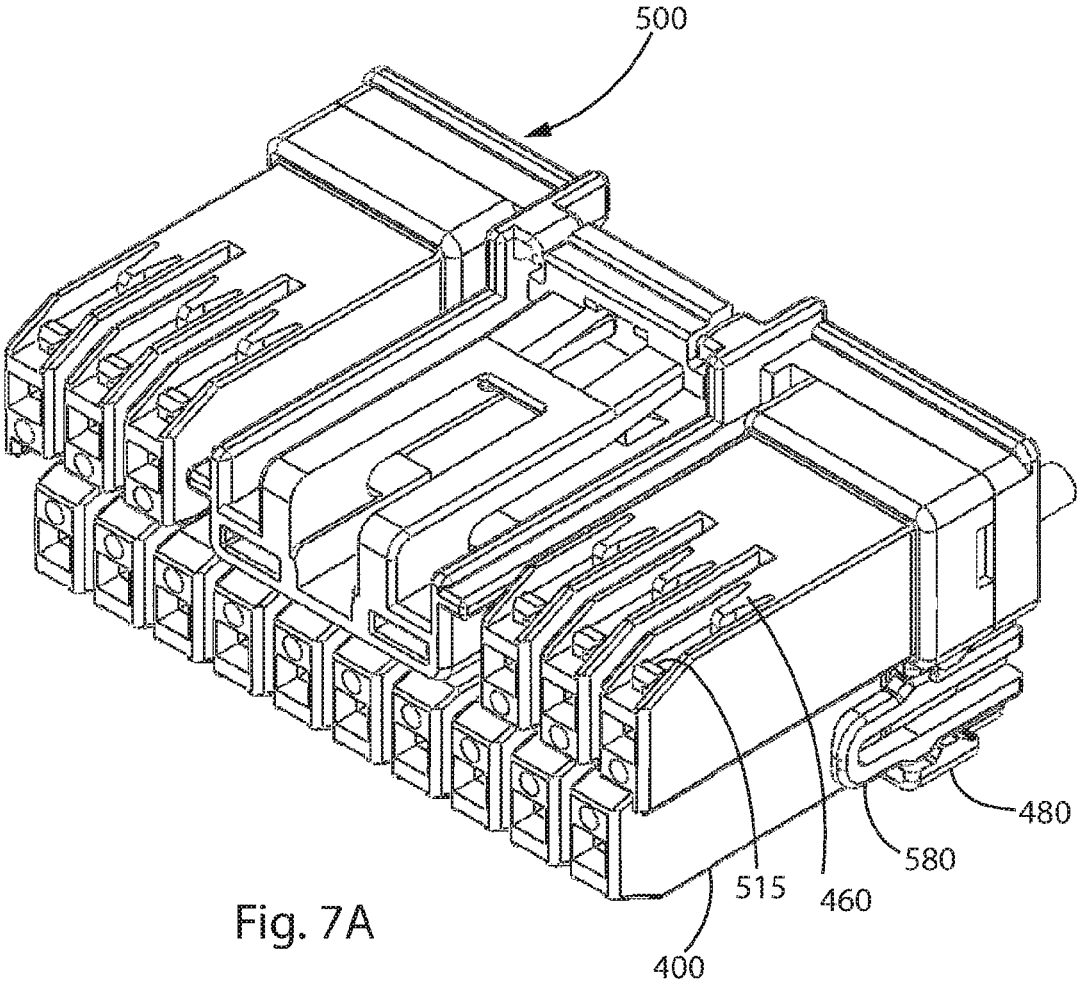
FIG. 7A is a perspective view showing the multiple cavity embodiment of the invention with the female shroud mated to the terminal carrier lock in the fully locked position.
Figure 7B:
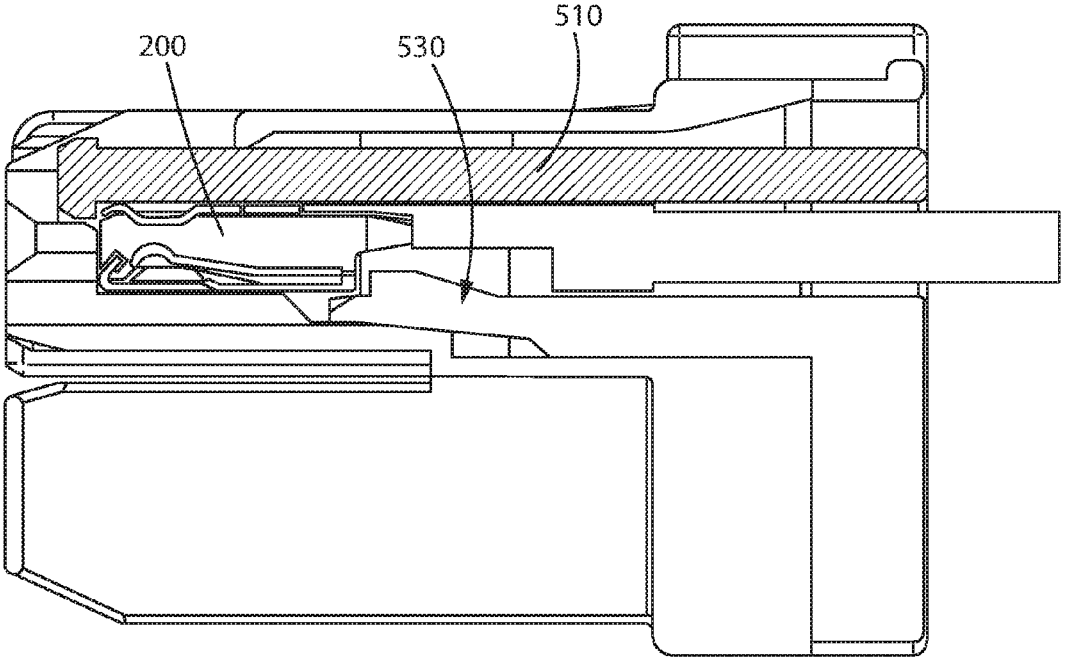
FIG. 7B is a longitudinal vertical cross-sectional view through the pre-locked connector of FIG. 7.

FIG. 7 illustrates this multiple-cavity embodiment with the female shroud 400 and the terminal carrier lock 500 mated in the locked position. The structure can be understood to generally correspond to that of FIG. 3 for the one-cavity embodiment.

Typically, in use, a connector position assurance member (not shown) would be inserted into the connector position assurance receiving unit 590. The use of a connector position assurance assembly is conventional in the art and is not described further here.

In the present invention, each cavity of the connector includes a TPA retention feature achieves the pre-lock of the terminal carrier lock to the female shroud. This assures that the two connectors cannot be separated beyond the pre-lock position while not inhibiting the movement from pre-lock to final lock position. The connector of the invention is of particular use in the automotive industry, in which it is conventional to prepare the terminal carrier lock pre-locked to the female shroud, and to ship the pre-locked units to the site where they will be installed in the automobile.

LIST OF REFERENCE NUMERALS

100 Terminal carrier lock
105, 505 Housing
107 Cavity
110, 510 Forward Stop Structure
115, 515 Terminal Forward Stop
120, 520 Pre-lock retention ledge
130 Primary terminal lock
135, 535 Beam
140, 540 Lock Surface
145, 545 Tip
150 Female shroud of connector
160, 460 Shroud retention feature
170 Shroud housing
200 Terminal
250 Positive lock retention (PLR) surface
260 Shelf
400 Female shroud, multiple-cavity embodiment
480 Main connection latch female portion
500 Terminal carrier lock, multiple-cavity embodiment
580 Main connection latch male portion
590 Connector position assurance receiving structure
600 Cable

What is claimed is:

1. A terminal carrier lock of a connector, said terminal carrier lock comprising:
a housing defining a cavity;
a forward stop structure connected to the housing on one side of the cavity and extending away from the housing on one side of the housing; and
a primary terminal lock connected to the housing on the opposite side of the cavity and extending away from the housing on the same side as the forward stop structure;
wherein said forward stop structure comprises:
a pre-lock retention ledge on a side of the forward stop structure facing away from the primary terminal lock, said pre-lock retention ledge facing toward the housing; and
a terminal forward stop on a side of the forward stop structure facing the primary terminal lock, said terminal forward stop facing toward the housing; and
wherein said primary terminal lock comprises:
a beam connected to the housing, said beam being flexible in the directions toward and away from the forward stop structure;
a lock surface at the end of the beam, said lock surface facing away from the housing; and
a tip extending further away from the housing past said lock surface.

2. A connector system, comprising:
the terminal carrier lock of claim 1; and
a female shroud, comprising:
a shroud housing defining a cavity;
a shroud retention feature on one side of the housing; and
a positive lock retention surface and a terminal position assurance shelf on the inside of the housing facing the cavity of the female shroud, for contacting the tip of the primary terminal lock.

3. The connector system of claim 2, wherein:
the terminal carrier lock is inserted into the cavity of the shroud housing of the female shroud such that said pre-lock retention ledge passes the shroud retention feature, thereby placing the connector system in a pre-lock configuration.

4. The connector system of claim 3, further comprising:
a terminal inserted through the cavity of said terminal carrier lock, said terminal being positioned between said terminal forward stop and said lock surface.

5. A terminal carrier lock of a connector, said terminal carrier lock comprising:
a housing defining a plurality of cavities;
a forward stop structure for each cavity, connected to the housing on one side of the cavity and extending away from the housing on one side of the housing; and
a primary terminal lock for each cavity, connected to the housing on the opposite side of the cavity from the forward stop structure, and extending away from the housing on the same side as the forward stop structure;
wherein each forward stop structure comprises:
a pre-lock retention ledge on a side of the forward stop structure facing away from the primary terminal lock, said pre-lock retention ledge facing toward the housing; and
a terminal forward stop on a side of the forward stop structure facing the primary terminal lock, said terminal forward stop facing toward the housing; and
wherein each primary terminal lock comprises:
a beam connected to the housing, said beam being flexible in the directions toward and away from the forward stop structure;
a lock surface at the end of the beam, said lock surface facing away from the housing; and
a tip extending further away from the housing past said lock surface.

6. The terminal carrier lock of claim 5, further comprising:
a connector position assurance receiving structure connected to the housing.

7. A female shroud, comprising:
a shroud housing defining a plurality of cavities;
a plurality of shroud retention features on the housing, one for each cavity; and
for each cavity, a positive lock retention surface and a terminal position assurance shelf on the inside of the housing facing the cavity, for contacting the tip of a primary terminal lock.

8. A connector system comprising:
the terminal carrier lock of claim 6; and
a female shroud, comprising:
a shroud housing defining a plurality of cavities aligned with the cavities of the terminal carrier lock;
a plurality of shroud retention features on the housing, one for each cavity of the female shroud; and
for each cavity of the female shroud, a positive lock retention surface and a terminal position assurance shelf on the inside of the housing facing the cavity, for contacting the tip of a primary terminal lock.

9. The connector system of claim 8, wherein:
the terminal carrier lock is inserted into the cavity of the shroud housing of the female shroud such that each of the plurality of pre-lock retention ledges passes a corresponding shroud retention feature, thereby placing the connector system in a pre-lock configuration.

10. The connector system of claim 9, further comprising:
at least one terminal inserted through a cavity of said terminal carrier lock, said terminal being positioned between the terminal forward stop and the lock surface corresponding to that cavity.

11. A method of providing an electrical connection, comprising the step of:

inserting a terminal carrier lock into a female shroud, wherein:

said terminal carrier lock comprises:

a housing defining a plurality of cavities;

a forward stop structure for each cavity, connected to the housing on one side of the cavity and extending away from the housing on one side of the housing; and a primary terminal lock for each cavity, connected to the housing on the opposite side of the cavity from the forward stop structure, and extending away from the housing on the same side as the forward stop structure;

wherein each forward stop structure comprises:

a pre-lock retention ledge on a side of the forward stop structure facing away from the primary terminal lock, said pre-lock retention ledge facing toward the housing; and a terminal forward stop on a side of the forward stop structure facing the primary terminal lock, said terminal forward stop facing toward the housing; and wherein each primary terminal lock comprises:

a beam connected to the housing, said beam being flexible in the directions toward and away from the forward stop structure;

a lock surface at the end of the beam, said lock surface facing away from the housing; and a tip extending further away from the housing past said lock surface; and said female shroud comprises:

a shroud housing defining a plurality of cavities corresponding to and aligned with the cavities of the terminal carrier lock;

a plurality of shroud retention features on the housing, one for each cavity of the female shroud; and for each cavity of the female shroud, a positive lock retention surface and a terminal position assurance shelf on the inside of the housing facing the cavity, for contacting the tip of a primary terminal lock;

wherein in the inserting step each terminal carrier lock is inserted into a cavity of the shroud housing of the female shroud such that said pre-lock retention ledge passes a corresponding shroud retention feature, thereby placing the connector system in a pre-lock configuration.

12. The method of claim 11, further comprising the step of:

inserting at least one terminal through a cavity of said terminal carrier lock until the terminal is positioned between the terminal forward stop and the lock surface corresponding to that cavity.

* * * * *